US011952726B2

(12) United States Patent
Salas Araujo

(10) Patent No.: US 11,952,726 B2
(45) Date of Patent: Apr. 9, 2024

(54) TISSUE WITH NANOFIBRILLAR CELLULOSE SURFACE LAYER

(71) Applicant: GPCP IP Holdings LLC, Atlanta, GA (US)

(72) Inventor: Carlos L. Salas Araujo, Apex, NC (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 17/402,548

(22) Filed: Aug. 15, 2021

(65) Prior Publication Data

US 2021/0372054 A1 Dec. 2, 2021

Related U.S. Application Data

(62) Division of application No. 16/992,257, filed on Aug. 13, 2020, now Pat. No. 11,124,920.

(Continued)

(51) Int. Cl.
*D21H 27/38* (2006.01)
*D21F 5/18* (2006.01)

(Continued)

(52) U.S. Cl.
CPC ..... *D21H 27/38* (2013.01); *D21F 5/181* (2013.01); *D21H 11/18* (2013.01); *D21H 27/002* (2013.01)

(58) Field of Classification Search
CPC ..... D21H 27/38; D21H 11/18; D21H 27/002; D21H 27/30; D21H 23/50; D21H 11/00;

(Continued)

(56) References Cited

U.S. PATENT DOCUMENTS 3,994,771 A 11/1976 Morgan, Jr. et al.
4,102,737 A 7/1978 Morton (Continued)

FOREIGN PATENT DOCUMENTS

WO 2016122956 A1 8/2016

OTHER PUBLICATIONS

Ketola, A., Strand, A., Sundberg, A., Kouko, J., Oksanen, A., Salminen, K., Fu, S., and Retulainen, E. (2018). "Effect of micro- and nanofibrillated cellulose on the drying shrinkage, extensibility, and strength of fibre networks," BioResources. 13(3), 5319-5342. (Year: 2018) (Year: 2018).*

(Continued)

*Primary Examiner* — Eric Hug
*Assistant Examiner* — Matthew M Eslami

(57) ABSTRACT

A method of making a tissue basesheet includes: (a) forming a nascent web from an aqueous furnish of papermaking fiber; (b) applying an aqueous composition of nanofibrillar cellulose to a surface of the nascent web; and (c) drying the nascent web to provide the tissue basesheet. Typically the basesheet is constructed with a tissue substrate of cellulosic papermaking fiber having applied to a surface thereof a layer of nanofibrillar cellulose, the tissue substrate having a basis weight of from 15 g/m$^2$ to 30 g/m$^2$ and the layer of nanofibrillar cellulose having a coatweight of from 0.25 g/m$^2$ to 3 g/m$^2$. The product may be incorporated into 2-ply or 3-ply bath tissue.

21 Claims, 7 Drawing Sheets

Related U.S. Application Data

(60) Provisional application No. 62/900,691, filed on Sep. 16, 2019.

(51) Int. Cl.
*D21H 11/18* (2006.01)
*D21H 27/00* (2006.01)

(58) Field of Classification Search
CPC ... D21F 5/181; D21F 11/14; B32B 2262/062; C08L 1/00
See application file for complete search history.

(56) References Cited

U.S. PATENT DOCUMENTS

| | | | |
|---|---|---|---|
| 4,351,699 | A | 9/1982 | Osborn, III |
| 4,441,962 | A | 4/1984 | Osborn, III |
| 4,447,294 | A | 5/1984 | Osborn, III |
| 4,529,480 | A | 7/1985 | Trokhan |
| 5,240,562 | A | 8/1993 | Phan |
| 5,279,767 | A | 1/1994 | Phan |
| 5,281,348 | A | 1/1994 | Letscher |
| 5,558,573 | A | 9/1996 | Basile |
| 5,622,597 | A | 4/1997 | Callen |
| 5,698,076 | A | 12/1997 | Phan |
| 5,730,839 | A | 3/1998 | Wendt |
| 5,753,079 | A | 5/1998 | Jenny |
| 7,399,378 | B2 | 7/2008 | Edwards |
| 7,585,388 | B2 | 9/2009 | Yeh |
| 7,585,389 | B2 | 9/2009 | Yeh |
| 7,662,257 | B2 | 2/2010 | Edwards |
| 7,700,764 | B2 | 4/2010 | Heijnesson-Hulten |
| 7,736,464 | B2 | 6/2010 | Kokko |
| 7,850,823 | B2 | 12/2010 | Chou |
| 7,951,266 | B2 | 5/2011 | Kokko |
| 8,287,692 | B2 | 10/2012 | Miyawaki |
| 8,377,563 | B2 | 2/2013 | Miyawaki |
| 8,546,558 | B2 | 10/2013 | Ankerfors |
| 8,647,468 | B2 | 2/2014 | Heiskanen |
| 8,728,273 | B2 | 5/2014 | Heiskanen |
| 8,747,612 | B2 | 6/2014 | Heiskanen |
| 8,778,134 | B2 | 7/2014 | Vehvilainen |
| 8,778,138 | B2 | 7/2014 | Super |
| 8,968,517 | B2 | 3/2015 | Ramaratnam |
| 8,992,728 | B2 | 3/2015 | Isogai |
| 9,051,684 | B2 | 6/2015 | Hua |
| 9,175,441 | B2 | 11/2015 | Heiskanen |
| 9,382,666 | B2 | 7/2016 | Ramaratnam |
| 9,506,203 | B2 | 11/2016 | Ramaratnam |
| 9,580,872 | B2 | 2/2017 | Ramaratnam |
| 9,702,089 | B2 | 7/2017 | Ramaratnam |
| 9,702,090 | B2 | 7/2017 | Ramaratnam |
| 9,725,853 | B2 | 8/2017 | Ramaratnam |
| 9,777,143 | B2 | 10/2017 | Sumnicht |
| 9,822,285 | B2 | 11/2017 | Sumnicht |
| 9,995,005 | B2 | 6/2018 | Ramaratnam |
| 10,005,932 | B2 | 6/2018 | Sumnicht |
| 10,138,599 | B2 | 11/2018 | Aulin |
| 10,190,263 | B2 | 1/2019 | Ramaratnam |
| 2011/0011550 | A1 | 1/2011 | Noda |
| 2011/0277947 | A1 | 11/2011 | Hua |
| 2014/0083634 | A1 | 3/2014 | Bjoerkqvist |
| 2014/0209264 | A1 | 7/2014 | Tirimacco |
| 2014/0284407 | A1 | 9/2014 | Tamper |
| 2015/0167243 | A1 | 6/2015 | Bilodeau |
| 2016/0122947 | A1 | 5/2016 | Kajanto et al. |
| 2016/0145810 | A1 | 5/2016 | Miller, IV |
| 2016/0215179 | A1 | 7/2016 | Sumnicht |
| 2017/0204304 | A1 | 7/2017 | Yu |
| 2017/0254025 | A1 | 9/2017 | Miller |
| 2017/0298574 | A1* | 10/2017 | Ramaratnam ..... D21H 27/30 |
| 2017/0314206 | A1 | 11/2017 | Sealey |
| 2017/0314207 | A1 | 11/2017 | Sealey |
| 2018/0002502 | A1 | 1/2018 | Ziegenbein |
| 2018/0002864 | A1 | 1/2018 | Ziegenbein |
| 2018/0078099 | A1 | 3/2018 | Ziegenbein |
| 2018/0187377 | A1 | 7/2018 | Ziegenbein |
| 2018/0195239 | A1 | 7/2018 | Ziegenbein |
| 2018/0202109 | A1 | 7/2018 | Chen |
| 2018/0209100 | A1 | 7/2018 | Mckee |
| 2018/0230344 | A1 | 8/2018 | Sumnicht |
| 2018/0281493 | A1 | 10/2018 | Miikki |
| 2018/0313038 | A1 | 11/2018 | Bradbury |
| 2019/0003123 | A1 | 1/2019 | Kokko |
| 2019/0062570 | A1 | 2/2019 | Megaridis |
| 2020/0255548 | A1 | 8/2020 | Qin |

OTHER PUBLICATIONS

Brodin, et al., "Cellulose nanofibrils: Challenges and possibilities as a paper additive or coating material—A review", Nordic Pulp & Paper Research Journal, vol. 29, Issue '1, Jul. 19, 2019, pp. 156-166.

International Search Report and Written opinion received for PCT Application No. PCT/IB2020/057775, dated Feb. 12, 2021, 10 pages.

Ketola, et al., "Effect of Micro-and Nanofibrillated Cellulose on the Drying Shrinkage, Extensibility, and Strength of Fibre Networks", BioResources, vol. 13, Issue 3, 2018, pp. 5319-5342.

Rojas, et al., "the Dispersion Science of Papermaking", Journal of Dispersion Science and Technology, vol. 25, No. 6, 2004, pp. 713-732.

Third Party Observation received for Mexican Patent Application No. MX/a/2022/003188 on Jul. 25, 2022, 14 pages (5 pages of English Translations and 9 Pages of Official notifications).

* cited by examiner

CONTROL

CONTROL

CONTROL

TISSUE WITH NANOFIBRILLAR CELLULOSE SURFACE LAYER

CLAIM FOR PRIORITY

This application is a divisional application based on copending U.S. patent application Ser. No. 16/992,257, filed Aug. 13, 2020, now U.S. Pat. No. 11,124,920. U.S. patent application Ser. No. 16/992,257 is based on U.S. Provisional Application Ser. No. 62/900,691 filed Sep. 16, 2019. The priority of the foregoing applications is hereby claimed and their disclosures incorporated into this application by reference.

TECHNICAL FIELD

The present invention relates to absorbent paper tissue, particularly bath tissue with a nanofibrillar cellulose surface layer. The product has increased strength without sacrificing softness or dispersibility. cl BACKGROUND The softness of tissue products is a key property for consumers/users of bath tissue paper. Different approaches have been explored and are available in the patent literature to impart softness to tissue webs. Increasing softness is a challenging task because of the inverse relationship of softness with strength. This inverse relationship makes it difficult to deliver a soft, yet strong tissue product. One way conventionally employed to overcome this issue is by applying appropriate surface chemistries, for example, surfactants as debonders and softeners to the tissue web so that hand feel is improved; however, with the use of such chemistries, other issues such as linting and/or pilling might be exacerbated. Moreover, debonder tends to decrease tensiles of the sheet, making processing difficult. One way of compensating for reduced strength is to refine the furnish; however, this increases stiffness of the product and has an adverse effect on softness.

Another approach seen in a recent patent application is to apply starch and hydroxyl polymer (such as polyvinyl alcohol) filaments to the surface of layered fibrous substrates (US2018/0209100A1). The disclosed approach involves the deposition of the starch and polyvinyl alcohol filaments on the surface of the fibrous web substrate and bonding of said filaments to the substrate by thermal fusion. The product is reported to exhibit reduced linting and enhanced softness. This approach appears to break the paradigm between softness and strength of tissue products as the layer of bonded fibers can provide softness without affecting the strength of the product. However, the method would be difficult to implement on existing papermachines and the filaments are likely to adversely impact dispersibility and flushability of the product.

Nanofibrillar and fibrillated cellulose has been used in connection with the manufacture of paper products, including absorbent sheet as a component in the papermaking furnish or in connection with ply-bonding adhesives for multilayer products.

U.S. Pat. No. 10,005,932 discloses a ply-bonding adhesive of polyvinyl alcohol and nanofibrillated cellulose useful for tissue and towel. See, also, U.S. Pat. No. 9,822,285 and United States Patent Application Publication No. US2018/0230344. United States Patent Application Publication No. US2017/0204304 discloses a tail-sealing adhesive with nanofibrillated cellulose.

United States Patent Application Publication No. US2011/0011550 discloses a method of improving the hand-feel of tissue by fibrillating the furnish by cavitation. See ¶¶ [0073]-[0076]. United States Patent Application Publication No. US2018/0187377 discloses high aspect ratio nanofibrillated cellulose mixed with the papermaking furnish. See Example 1, ¶¶ [0147]-[0157]. See, also United States Patent Application Publication Nos. US2018/0195239; US2018/0078099; US2018/0002864; and US2018/0002502.

United States Patent Application Publication No. US2019/0062570 discloses a composition for imparting a hydrophobic surface to a sheet including fluorinated or perfluorinated polymers. The composition may include microfibrillated or nanofibrillated cellulose. See Abstract, ¶¶ [0080]-[0099].

United States Patent Application Publication No. US2018/0313038 discloses absorbent sheet manufacture wherein microfibrillated cellulose is added to the stock system with a strength agent or applied to a web together with a strength agent using a spray shower. See ¶¶ [0081]-[0082].

U.S. Pat. No. 9,175,441 discloses a method of making paper or paperboard by adding microfibrillated cellulose between the plies. See Col. 2, line 65 to Col. 3, line 3, wherein it is noted the microfibrillated cellulose may be applied by spraying.

U.S. Pat. No. 10,138,599 discloses a coated paper packaging material. The coating is made with microfibrillated cellulose and is reported to have superior oxygen transmission and grease barrier properties. See Col. 12, Tables 2 and 3.

U.S. Pat. No. 9,777,143 relates to polyvinyl alcohol fibers and films with fillers such as cellulose nanofibrils or cellulose fines. See Col. 8, lines 1-28.

U.S. Pat. No. 9,051,684 discloses high aspect ratio cellulose nanofilaments. The nanofilaments are reported as a reinforcement additive for paper, Cols. 9-10. See, also, Col. 12, lines 18-29.

U.S. Pat. No. 10,190,263 discloses through air dried tissue. This reference teaches multi-ply products wherein plies are treated with a corona discharge and optionally nano-cellulose fibers, microfibrillated cellulose and other shaped material or synthetic fibers which may be blown onto the sheet immediately after corona discharge, which enables the nano-fibers to absorb onto the sheet by electro-static attraction. See Col. 11, lines 36-50. See, also, U.S. Pat. Nos. 8,968,517; 9,382,666; 9,506,203; 9,580,872; 9,702,089; 9,702,090; 9,725,853; and 9,995,005, as well as United States Patent Application Publication Nos. US2016/0145810; US2017/0314207; and US2017/0314206.

SUMMARY OF INVENTION

In the present invention micro/nanofibrillar cellulose is applied to the surface of tissue webs, preferably by spraying it on the surface of a wet web at the paper machine. Nanofibrillar cellulose offers several advantages such as high surface area, suitable as rheology modifier, availability of hydroxyl (OH) groups that allow further chemical modification and further advantages as noted herein. Nanofibrillar cellulose has been evaluated in a myriad of applications, from composite materials, colloids, food, adhesives, biomedical applications, building materials, additive in oil drilling fluids and in papermaking as strength additive and in coating formulations and adhesives. In the literature, nanofibrillar cellulose is sometimes referred to as microfibrillar cellulose and different acronyms are used to describe it such as MFC, NFC and CNF. For present purposes, the material is referred to as nanofibrillar cellulose or simply NFC. NFC is a material composed of nanosized cellulose fibrils with a high aspect ratio (length to width ratio). Typical fibril widths are 5-20 nanometers with a wide range of lengths, typically several micrometers. It is pseudo-plastic and exhibits thixotropy, the property of certain gels or fluids that are thick (viscous) under normal conditions, but become less viscous under shear. When the shearing forces are removed the gel regains much of its original viscosity. The fibrils may be isolated from any cellulose containing source including wood-based fibers (pulp fibers) through high-pressure, high temperature and high velocity impact homogenization, grinding or microfluidization.

The spray of NFC may be applied after the wet web is formed on the formation wire and immediately before transfer to a felt, however the application can also be done at the formation wire or at the felt, either on the Yankee or the air side of the sheet, depending on papermachine configuration. The present invention may be practiced on any papermachine with or without a papermaking felt. Suitable papermachines include a conventional wet-press papermachine with a Yankee dryer such as shown in FIG. 4, a wet-crepe papermachine, a through-air dried papermachine (TAD) with or without creping (UCTAD). Preferred embodiments include Applicant's fabric crepe methodology to make structured basesheet as is described in U.S. Pat. No. 7,399,378 and related patents noted herein. The application of NFC does not require extra equipment on the paper machine, other than a spray boom. In addition, because of the high surface area of microfibrillar cellulose, these fibrils can serve as a vehicle for the delivery of other active components to the surface of the web, such as dispersants, softeners and debonders in relatively low dosages without affecting the papermaking process or reducing tensiles of the product. Instead of spray nozzles, a curtain coating apparatus may be adapted to the process if appropriate to the papermachine layout.

In one aspect of the invention there is provided a method of making a tissue basesheet by way of (a) forming a nascent web from an aqueous furnish of papermaking fiber; (b) applying an aqueous composition of nanofibrillar cellulose to a surface of the nascent web; and (c) drying the nascent web to provide the tissue basesheet.

In another aspect of the invention there is provided a basesheet constructed with a tissue substrate of cellulosic papermaking fiber having applied to a surface thereof a layer of nanofibrillar cellulose, the tissue substrate having a basis weight of from 15 g/m$^2$ to 30 g/m$^2$ and the layer of nanofibrillar cellulose having a coatweight of from 0.25 g/m$^2$ to 3 g/m$^2$.

The product may be incorporated into 2-ply or 3-ply bath tissue.

The invention provides tissue with unexpectedly high increases in tensiles without a substantial impact on the softness of the products, as is seen in FIG. 1, which is a plot of softness versus geometric mean (GM) tensile. It is seen the product without an NFC layer exhibits a softness value of 18.6 and a GM tensile value of about 940 g/3" (123 g/cm); while the invention 2-ply products exhibit tensiles of over 1275 g/3" (167 g/cm) and softness values of 18 or more.

Still further features and advantages of the invention are described in the discussion which follows and seen in the appended Figures.

BRIEF DESCRIPTION OF DRAWINGS

The invention is described in detail below with reference to the drawings wherein.

DETAILED DESCRIPTION

Figure 1:
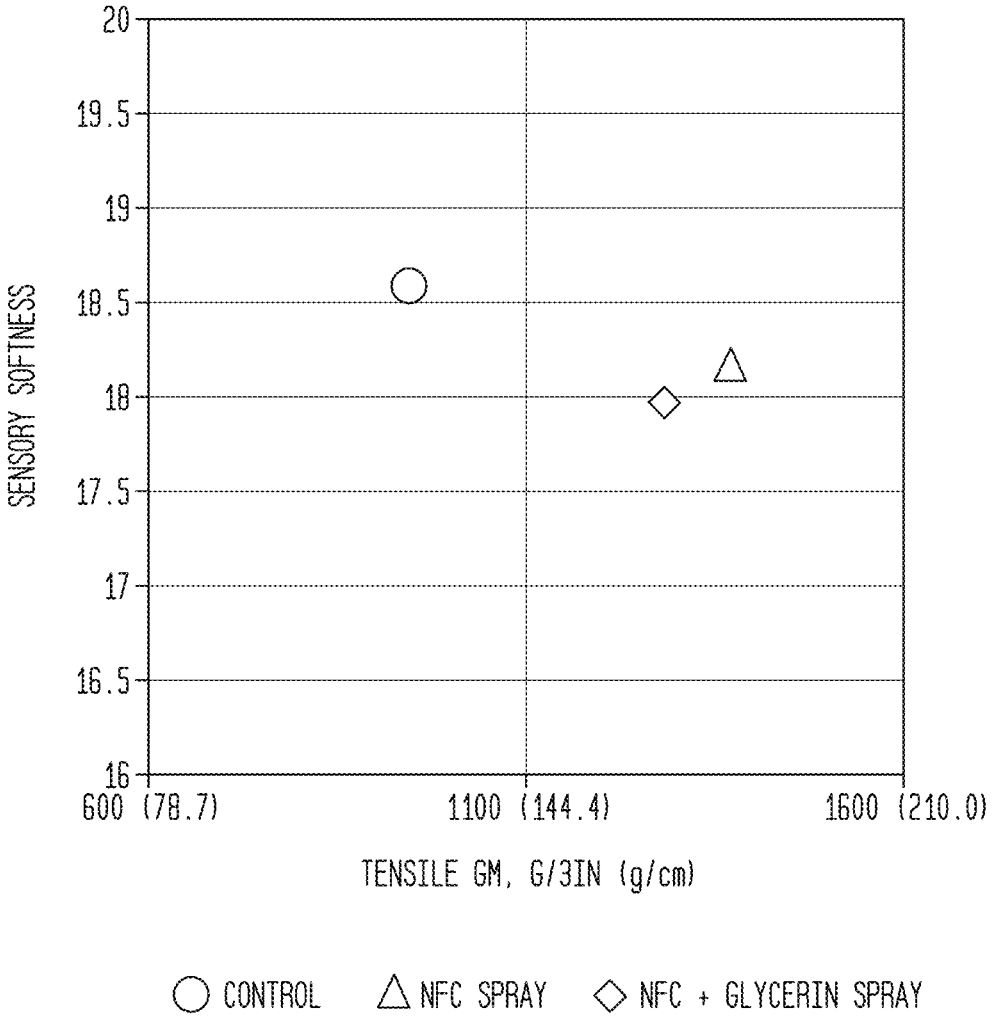
FIG. 1 is a plot of trained panel softness (arbitrary scale) versus GM tensile for 2-ply products of the invention and for a like product without an NFC layer.

The invention is described in detail below in connection with the Figures for purposes of illustration only. The invention is defined in the appended claims. Terminology used herein is given its ordinary meaning consistent with the exemplary definitions set forth herein; g refers to grams, m$^2$ refers to square meters, percents, ppm and like terminology relates to weight percent, parts per million by weight unless otherwise indicated and so forth.

"Basesheet" refers to a unitary cellulosic sheet as manufactured by a papermachine. Base sheets may be layered; however, they have a unitary structure which is not readily delaminated. A "ply" of a finished product refers to base sheet incorporated into the product.

Basis weight, coatweight, add-on and the like are calculated on a dry basis.

"Characteristic Breaking Length" of nanofibrillar cellulose is measured on a handsheet prepared from 100% of nanofibrillar cellulose in accordance with Tappi Test Method T 205 sp-06 or equivalent using a porous membrane to dewater the handsheet as described hereinafter. Handsheet tensiles are measured in accordance with Tappi Test Method T 220 or equivalent.

Characteristic Nanofiber Viscosity or like designation refers to viscosity measured on a 0.5% or 1 wt % suspension of the NFC in water as further described herein.

"Consisting essentially of" and like terminology refers to the recited components and excludes other ingredients which would substantially change the basic and novel characteristics of the composition, article or process. Unless otherwise indicated or readily apparent, a composition or article consists essentially of the recited or listed components when the composition or article includes 90% or more by weight of the recited or listed components. That is, the terminology excludes more than 10% unrecited components. Any of the products disclosed and claimed herein may consist essentially of the recited components. In some embodiments, consisting essentially of may also exclude additional components altogether such as strength agents. Preferred products may be prepared without dry strength agents such as starch or resins and/or without wet strength resins such as polyamide-epichlorohydrin wet strength resins and the like.

Consistency refers to percent solids of a nascent web, suspension or slurry, for example, calculated on an air dry basis. A slurry having 80 percent water and 20 percent dry wastepaper has a consistency of 20 percent. "Air dry" or simply "dry" means including residual moisture, by convention up to about 10 percent moisture for pulp and up to about 6 percent for dried paper; while oven dry refers to pulp or paper which is dried in an oven for several hours and is significantly drier.

"Freeness" or CSF is determined in accordance with TAPPI Standard T 227 OM-94 (Canadian Standard Method).

A "like" basesheet or multi-ply product without a layer of nanofibrillar cellulose refers to a product identical to the product of the invention which is being compared in terms of structure, composition, basis weight and method of preparation except that the like product does not have a layer of NFC.

A "nascent web" refers to a tissue web which is formed from aqueous papermaking furnish on a forming wire or fabric or felt prior to drying. A nascent web may have a consistency of up to 75%, 80% or so, but typically has much lower consistency during the process and application of the nanofibrillar cellulose to the web.

"Nanofibrillar cellulose", NFC and like terminology refers to cellulosic fiber that has been mechanically and/or chemically and/or enzymatically treated so that it is composed of nanofibrils. The material consists of long and thin fibers which form a three-dimensional network, and these fibers have crystalline and amorphous regions. NFC has high viscosity and yield stress, it is shear thinning. The size distribution of the fibers may be wide, and while many fibers have diameters in nanoscale, there may be a large number of larger fibers as well. Moreover, the fibers are in a network structure and interconnected to each other. It is also possible to produce similar material as individual fibrils, with nanoscale diameter and narrow size distribution, if special separation methods or chemical treatments are used.

In general, the nanofibrillar cellulose may be composed of, that is, contains cellulose nanofibers having a width of from 3.5 nanometers to 35 nanometers and a length of from 500 nanometers to 4000 nanometers, more preferably, with a width of from 4 nanometers to 25 nanometers and a length of from 1000 nanometers to 3500 nanometers. Nanofibrillar cellulose as that terminology is used herein may be alternatively characterized by the breaking length of a film of the material or by way of Characteristic Viscosity reduction under shear at a specified percentage in water as described herein.

30

"Predominantly" means more than 50 percent by weight of the named species unless mole percent is specified. Papermaking fiber from which a product is made is "predominantly" softwood fiber if over 50 percent by weight of fiber in the product is softwood fiber (dry).

Softness is determined by trained panelists using an arbitrary scale and a reference specimen assigned a reference value.

For testing, test specimens are conditioned for 2 hours at 50 percent relative humidity and 23° C.±1° C. (73.4° F.±1.8° F.) unless otherwise indicated. Dry tensile strengths (machine direction or MD and cross machine direction or CD), stretch, ratios thereof, break modulus, stress and strain are measured with a standard Instron test device or other suitable elongation tensile tester which may be configured in various ways, typically using 3 or 1 inch (7.62 or 2.54 cm) wide strips of tissue, conditioned for 2 hours at 50 percent relative humidity and 23° C.±1° C. (73.4° F.±1.8° F.), with the tensile test run at a crosshead speed of 2 in/min (5.08 cm/min). Tensile strength is typically reported in breaking length (km) or g/3" (g/7.62 cm). Geometric mean (GM) tensile is the square root of the product of CD and MD tensile. Wet tensile may be measured using a three-inch (7.62 cm) wide strip of sheet that is folded into a loop, clamped in a special fixture termed a Finch Cup, then immersed in water. The Finch Cup, which is available from the Thwing-Albert Instrument Company of Philadelphia, Pa., is mounted onto a tensile tester equipped with a 2.0 pound (0.9 kg) load cell with the flange of the Finch Cup clamped by the tester's lower jaw and the ends of the specimen loop clamped into the upper jaw of the tensile tester. The sample is immersed in water that has been adjusted to a pH of 7.0+ or −0.1 and the tensile is tested after a 5 second immersion time. The results are expressed in breaking length (km) or g/3" (g/7.62 cm), dividing by two to account for the loop as appropriate.

A tissue product is typically characterized by having predominantly (more than 50% by weight based on fiber content) hardwood fiber.

EXAMPLES

Figure 2:
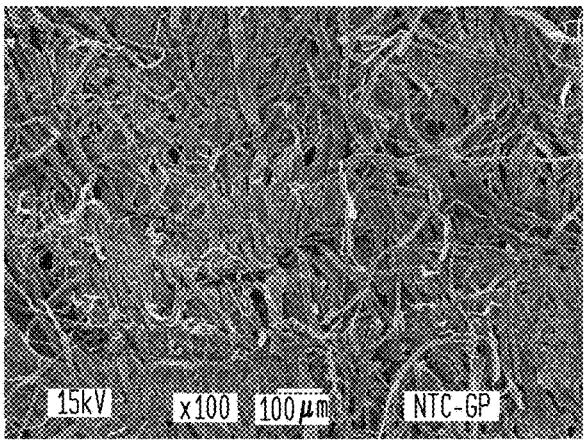
FIG. 2 is a collection of photomicrographs of basesheet of the invention with an NFC surface layer and a like basesheet without an NFC layer.
Figure 2:
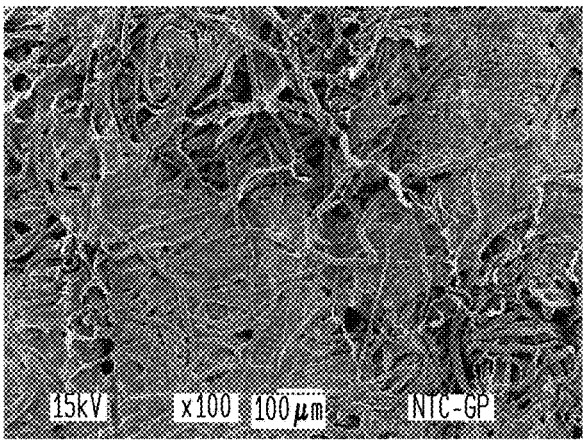
Figure 2:
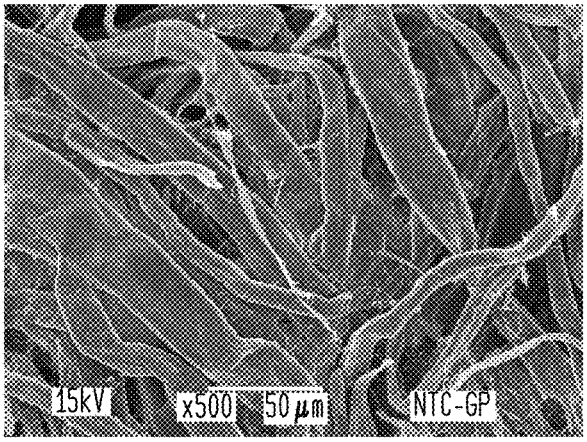
Figure 2:
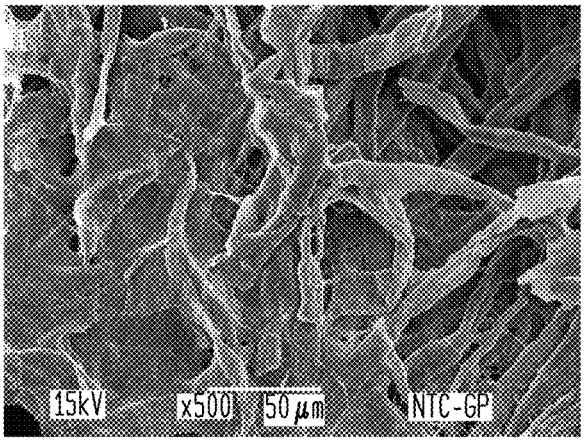
Figure 2:
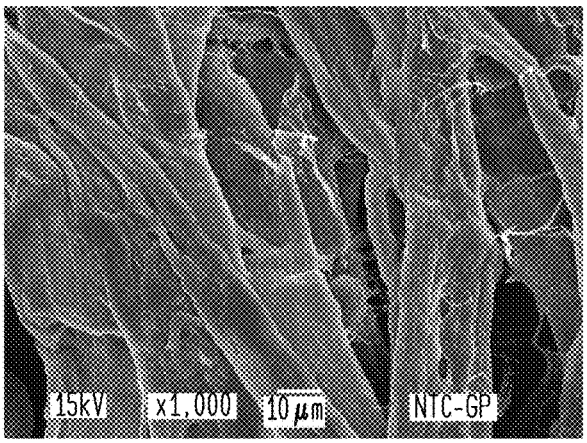
Figure 2:
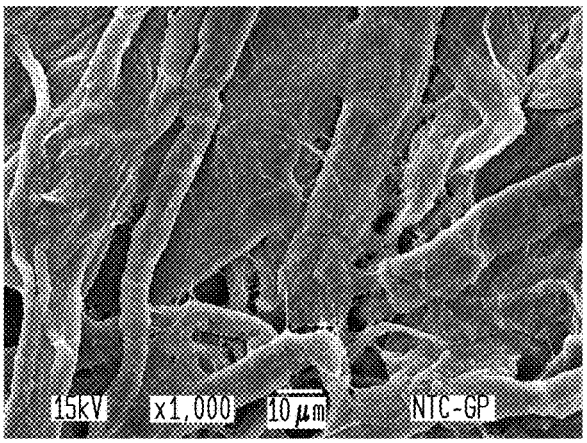

Nanofibrillar cellulose was sprayed on the Yankee surface of tissue basesheets to an approximate coat weight of 1.5 g/m$^2$ using a manual spray bottle. The concentration (consistency) of the aqueous NFC suspensions was 2 wt % and 1 wt %. Scanning electron microscopy (SEM) images of the basesheet surface after applying the microfibrillar cellulose from 1 wt % suspension to an approximate coat weight of 1.5 g/m$^2$ are shown in FIG. 2. In FIG. 2, the left column has SEM images of the surface of control sample (without microfibrillar cellulose) and the right column has SEM images of surface of basesheet samples after spraying microfibrillar cellulose. It can be seen from the images that the microfibrillar cellulose binds well to the surface of the basesheet fibers and the microfibrillar cellulose forms a uniform film on the surface of the tissue basesheet.

Paper Machine Trials

Utilizing a papermachine of the general class described below in connection with FIG. 4, an NFC suspension sprayed on the surface of tissue basesheets to an approximate coat weight of 0.65 g/m$^2$ using a spray boom with four nozzles each able to deliver a flowrate of 36.3 L/h. The concentration (consistency) of the aqueous NFC suspensions was 1 wt %; however, other concentrations can be used as available. The machine was operating at a speed of 100 ft/min (0.508 m/s) and the NFC was sprayed on the "Yankee side" of the sheet prior to transfer to the felt.

The papermachine trials, summarized in Table 1 below, consisted of control (tissue web without any spray), a web that was sprayed with NFC to a coat weight of 0.65 g/m$^2$, and a web that was sprayed with NFC to a coat weight of 0.65 g/m$^2$ plus glycerin in the same amount. The furnish consisted of southern hardwood (HW) and southern softwood (SW) baled pulp in a 65/35 HW/SW ratio. The Yankee layer was 100% HW and the air layer was of a 70/30 SW/HW split. SW was refined to 500 CSF.

TABLE 1

Experimental cells for spray application of microfibrillar cellulose on tissue webs

| Cell | Softwood Refined to 500 CSF | NFC add on g/m$^2$ | Concentration of NFC Suspension | Glycerin Add-on |
|---|---|---|---|---|
| 1 (Control) | Yes | 0 | N/A | 0 |
| 2 | Yes | 0.65 | 1 wt % | 0 |
| 3 | Yes | 0.65 | 1 wt % | Same as NFC |

The physical properties of the tissue webs (basesheets) were evaluated and rolls were converted into two-ply finished products for further evaluation of physical and sensory properties. The basesheet properties are presented in Table 2 below, the results indicate that the application of nanofibrillar cellulose produced an increase in dry strength of the paper of about 50% (tensile GM) for the sample with NFC application alone and about 28.7% for the sample with NFC+glycerin. There is also an increase in Break Modulus and wet tensile.

TABLE 2

Physical properties of bath tissue basesheets.

| | Control | NVC Spray | NFC spray + glycerin |
|---|---|---|---|
| Caliper 8 Sheet (mils/8 sht) | 50.93 | 48.89 | 51.33 |
| Basis Weight (lb/3000 ft^2) | 14.03 | 14.60 | 14.67 |
| Tensile MD (g/3 in) | 655.46 | 898.98 | 776.02 |
| Tensile CD (g/3 in) | 467.71 | 769.34 | 654.17 |
| Tensile GM (g/3 in) | 553.68 | 831.61 | 712.50 |
| Tensile Total Dry (g/3 in) | 1123.18 | 1668.32 | 1430.19 |
| Wet Tens Finch Cured-CD (g/3 in) | 43.71 | 62.39 | 45.92 |
| Break Modulus MD (g/3 in/%) | 23.12 | 31.76 | 30.62 |
| Break Modulus CD (g/3 in/%) | 111.37 | 171.31 | 137.12 |
| Break Modulus GM (g/3 in/%) | 50.73 | 73.76 | 64.80 |
| Stretch MD (%) | 28.57 | 28.59 | 26.63 |
| Stretch CD (%) | 4.28 | 4.72 | 4.74 |
| T.E.A. MD (mm-g/mm^2) | 1.04 | 1.62 | 1.35 |
| T.E.A. CD (mm-g/mm^2) | 0.14 | 0.24 | 0.21 |

Values are given SI units in Table 2A

TABLE 2A

Physical properties of bath tissue basesheets.

| | Control | NVC Spray | NFC spray + glycerin |
|---|---|---|---|
| Caliper 8 Sheet (mm/8 sht) | 1.294 | 1.242 | 1.304 |
| Basis Weight (g/m^2) | 22.83 | 23.76 | 23.87 |
| Tensile MD (g/cm) | 86.018 | 117.98 | 101.84 |
| Tensile CD (g/cm) | 61.379 | 100.96 | 85.849 |
| Tensile GM (g/cm) | 72.661 | 109.14 | 93.504 |
| Tensile Total Dry (g/cm) | 147.40 | 218.94 | 187.69 |
| Wet Tens Finch Cured-CD (g/cm) | 5.7362 | 8.1877 | 6.0262 |
| Break Modulus MD (g/cm/%) | 3.0341 | 4.1680 | 4.0184 |
| Break Modulus CD (g/cm/%) | 14.615 | 22.482 | 17.995 |
| Break Modulus GM (g/cm/%) | 6.6575 | 9.6798 | 8.5039 |
| Stretch MD (%) | 28.57 | 28.59 | 26.63 |
| Stretch CD (%) | 4.28 | 4.72 | 4.74 |
| T.E.A. MD (mm-g/mm^2) | 1.04 | 1.62 | 1.35 |
| T.E.A. CD (mm-g/mm^2) | 0.14 | 0.24 | 0.21 |

Figure 3:
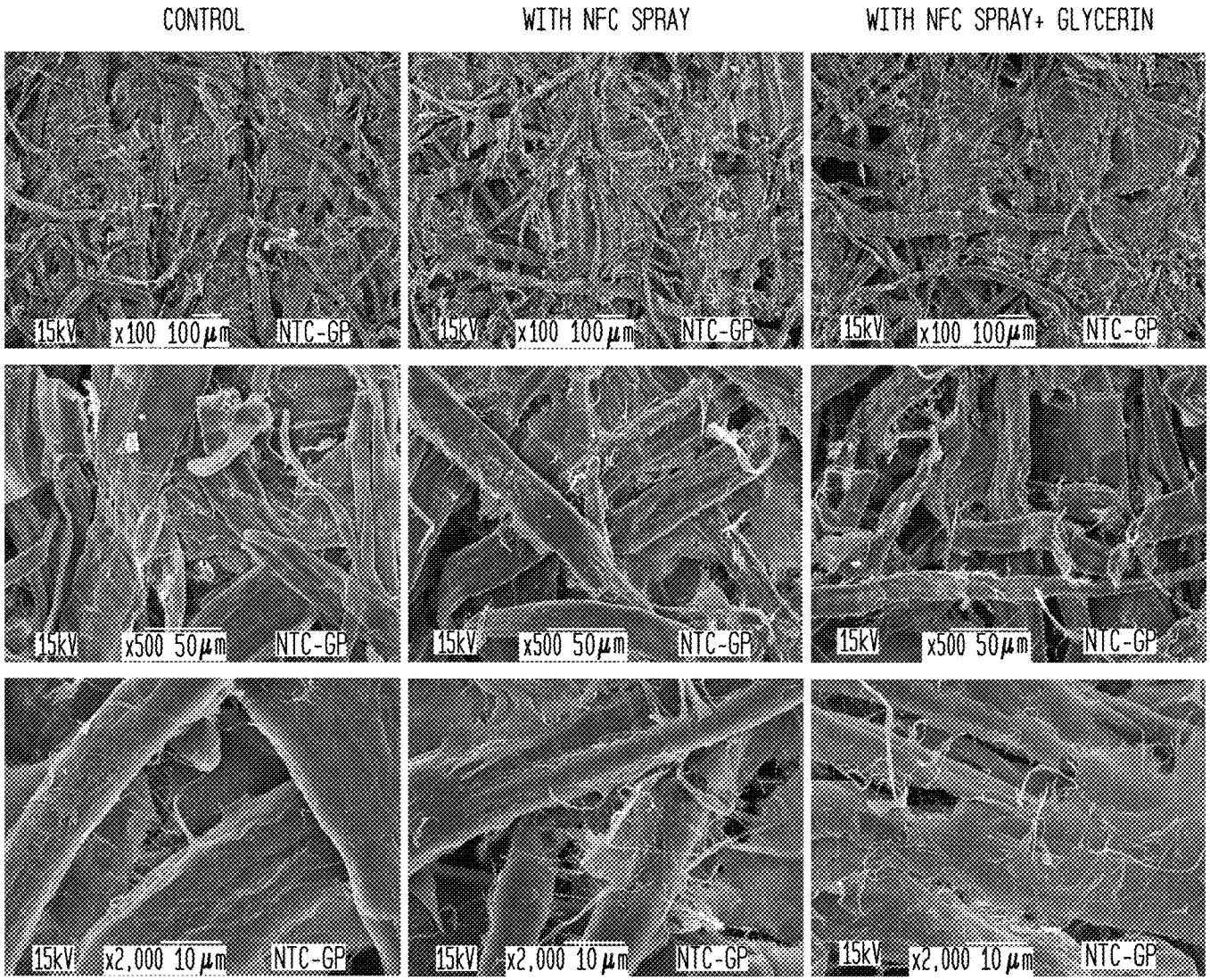
FIG. 3 is a collection of photomicrographs of basesheet of the invention with an NFC surface layer and a like basesheet without an NFC layer.

SEM images of the basesheet surfaces are shown in FIG. 3.

Basesheet was converted to 2-ply product by conventional means, reference U.S. Pat. No. 10,005,932 for converting machine configurations. The results for the finished products are shown on Table 3. The values indicate that similar to the basesheets, the finished products exhibit higher dry strength (about 46% more dry tensile GM for the sample with NFC application alone and about 37% for the sample with NFC+glycerin). The samples exhibit higher wet tensile strength and the sensory softness does not decrease substantially.

TABLE 3

Physical properties of two-ply finished products.

| | Control | NFC Spray | NFC + glycerin spray |
|---|---|---|---|
| Basis Weight (lb/3000 ft^2) | 26.74 | 28.40 | 29.487 |
| Caliper 8 Sheet (mils/8 sht) | 98.76 | 102.97 | 111.608 |
| Tensile MD (g/3 in) | 1251.81 | 1647.74 | 1580.111 |
| Tensile CD (g/3 in) | 702.77 | 1141.94 | 1045.006 |
| Tensile GM (g/3 in) | 937.79 | 1371.30 | 1284.816 |
| Wet Tens Finch CD (g/3 in) | 68.48 | 100.91 | 95.093 |
| Break Modulus MD (g/3 in) | 61.82 | 77.95 | 81.100 |
| Break Modulus CD (g/3 in) | 134.83 | 224.53 | 220.442 |
| Break Modulus GM (g/3 in) | 91.20 | 132.26 | 133.661 |
| Stretch MD (%) | 20.00 | 21.07 | 19.354 |
| Stretch CD (%) | 5.22 | 5.09 | 4.761 |
| Perf Tensile (g/3 in) | 400.75 | 581.86 | 499.262 |
| T.E.A. MD (mm-g/mm^2) | 1.41 | 2.16 | 1.931 |
| T.E.A. CD (mm-g/mm^2) | 0.24 | 0.37 | 0.310 |
| Roll Diameter (in) | 4.71 | 4.95 | 5.210 |
| Roll Comp (in) | 4.05 | 4.05 | 4.067 |
| Roll Compress Value (%) | 14.14 | 18.24 | 21.938 |
| Sensory Softness | 18.60 | 18.2 | 18.0 |

Values are given SI units in Table 3A

TABLE 3A

Physical properties of two-ply finished products.

| | Control | NFC Spray | NFC + glycerin spray |
|---|---|---|---|
| Basis Weight (g/m^2) | 43.52 | 46.22 | 47.99 |
| Caliper 8 Sheet (mm/8 sht) | 2.509 | 2.615 | 2.835 |
| Tensile MD (g/cm) | 164.28 | 216.24 | 207.3636 |
| Tensile CD (g/cm) | 92.227 | 149.86 | 137.1399 |
| Tensile GM (g/cm) | 123.07 | 179.96 | 168.611 |
| Wet Tens Finch CD (g/cm) | 8.9869 | 13.2428 | 12.479 |
| Break Modulus MD (g/cm) | 8.1129 | 10.2297 | 10.643 |
| Break Modulus CD (g/cm) | 17.694 | 29.4659 | 28.9294 |
| Break Modulus GM (g/cm) | 11.969 | 17.3570 | 17.5408 |
| Stretch MD (%) | 20.00 | 21.07 | 19.354 |
| Stretch CD (%) | 5.22 | 5.09 | 4.761 |
| Perf Tensile (g/cm) | 52.592 | 76.360 | 65.5200 |
| T.E.A. MD (mm-g/mm^2) | 1.41 | 2.16 | 1.931 |
| T.E.A. CD (mm-g/mm^2) | 0.24 | 0.37 | 0.310 |
| Roll Diameter (cm) | 12.0 | 12.6 | 13.2 |
| Roll Comp (cm) | 10.3 | 10.3 | 10.33 |
| Roll Compress Value (%) | 14.14 | 18.24 | 21.938 |
| Sensory Softness | 18.60 | 18.2 | 18.0 |

The trend in sensory softness vs tensile GM (referred as technology curve) is illustrated in the technology curve of FIG. 1. The sample with NFC application alone exhibits a drop of 0.4 points in sensory softness and the one with NFC+glycerin exhibit a drop of 0.6 points in sensory softness, i.e. applying NFC on the Yankee side surface of tissue webs reduces softness slightly, but not a substantial decrease. For comparison, using typical data from technology curves of conventional tissue making processes, the slope of a curve of softness vs tensile GM changes is about −0.003. Using the data in Table 3 and FIG. 1, one can predict the expected softness loss of a paper tissue if it follows the expected slope of −0.003. The calculations indicate that using the slope, the predicted softness of a sample which strength would be the same as the one obtained by spraying NFC only will be about 17.3 and that of a sample of the same strength as the NFC+glycerin sample would be about 17.6. This means that even though the spray of NFC slightly decreases softness, the obtained drop in softness is unexpectedly low, that is, not as high as would be the case if the increased strength was obtained by either refining or by using starch in the wet end as dry strength additive. Thus, the strength increases are unexpectedly high, while the softness loss is unexpectedly low, in fact insubstantial.

It may be possible to eliminate softness loss altogether when the NFC application is done in the air layer instead of the Yankee layer.

In summary, the invention discloses a method to increase the strength of bath tissue basesheets without significant negative effect on softness. The spray application can be done on the Yankee layer, or air layer of the tissue basesheets and from suspensions of different aqueous NFC concentrations (preferably 1% or 2%).

Product Preparation

Figure 7:
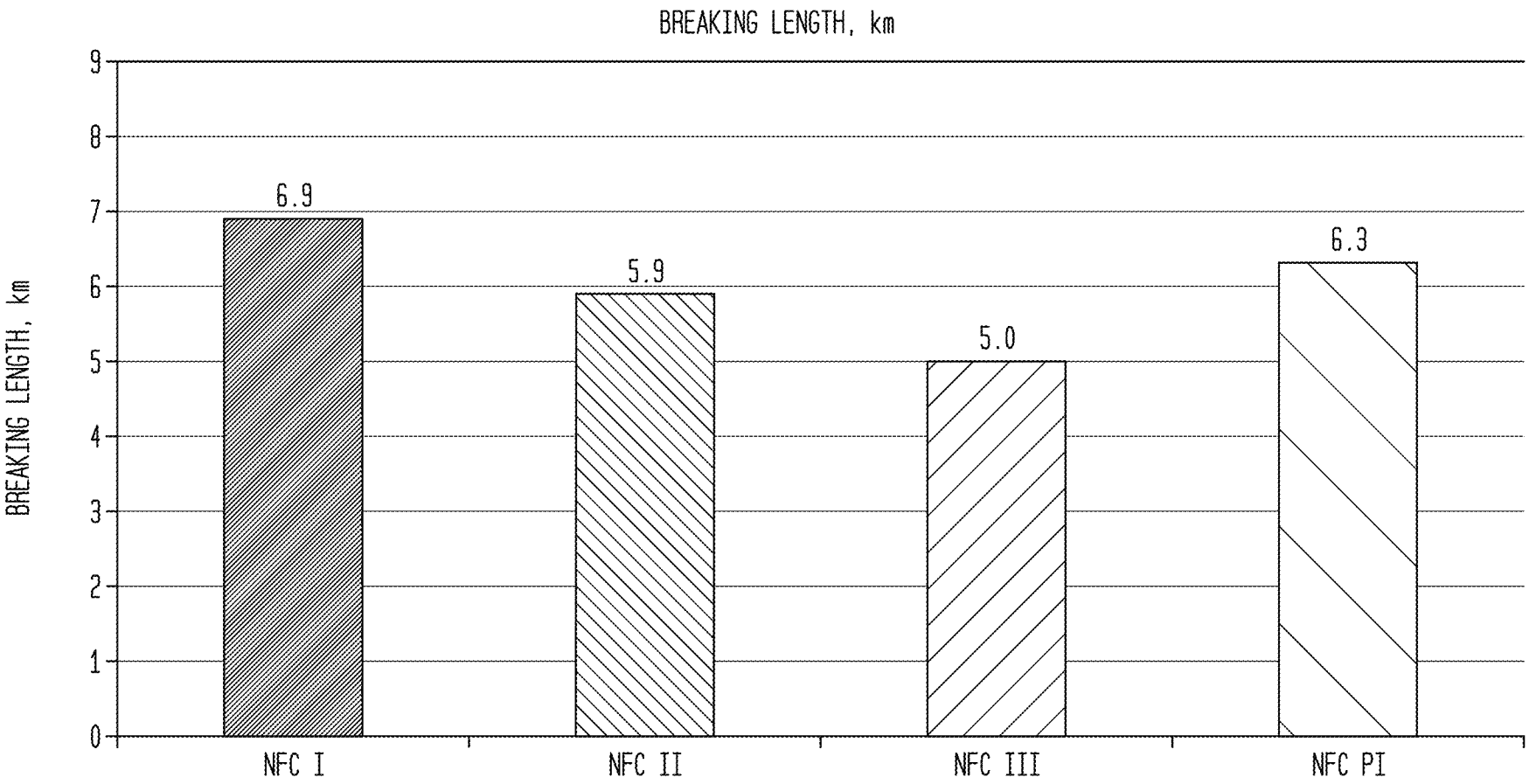
FIG. 7 is a histogram detailing Characteristic Breaking Length for 4 grades of NFC formed into handsheets or films.

The products of the invention may be made by any process suitable for making absorbent sheet, such as a "CWP" process which refers to absorbent products made by a conventional wet-press process; that is, wet-pressing a furnish to a drying cylinder with a papermaking felt followed by creping the web from the cylinder. See U.S. Pat. No. 7,951,266, FIG. 7 thereof.

Preferred embodiments include "Structured" basesheet which refers to product that is wet creped (fabric creped) from a cylinder prior to final drying. This product and methodology for its production is described in U.S. Pat. No. 7,399,378. See also U.S. Pat. Nos. 7,850,823; 7,585,388; 7,585,389; and 7,662,257.

Alternatively, a "TAD" process may be used which refers to through air dried processes for making absorbent products. Through air dried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. Uncreped or "UCTAD" processes may also be used for basesheet manufacture; these processes utilize through air drying and do not use a Yankee dryer.

Figure 4:
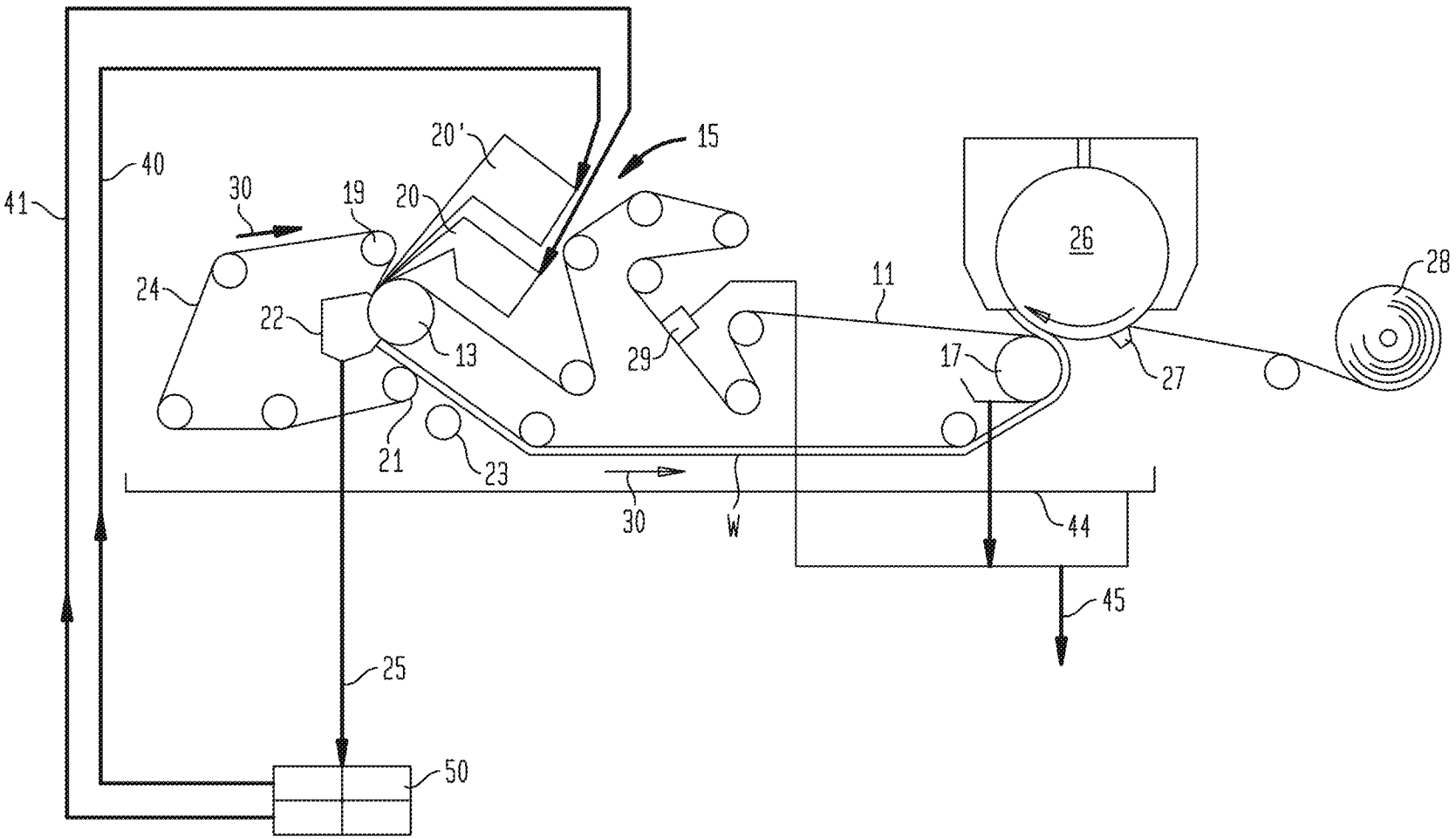
FIG. 4 is a schematic diagram of a conventional wet-press (CWP) papermachine modified with a spray boom to apply NFC.

There is shown in FIG. 4 a schematic diagram of a conventional wet-press (CWP) papermachine 15 modified with a spray boom and with multiple headboxes or a divided headbox thereby making it possible to produce a stratified product. That is, the product according to the present invention can be made with single or multiple headboxes, 20, 20' and regardless of the number of headboxes may be stratified or unstratified. The papermaking furnish is transported through different conduits 40 and 41, where it is delivered to the headbox of papermachine 15 as is well known, although any convenient configuration can be used.

FIG. 4 shows a web-forming end or wet end with a liquid permeable foraminous support member 11 which may be of any convenient configuration. Foraminous support member 11 may be constructed of any of several known materials including a conventional papermaking felt, fabric or a synthetic filament woven mesh base with a very fine synthetic fiber batt attached to the mesh base. The foraminous support member 11 is supported in a conventional manner on rolls, including breast roll 13 and pressing roll 17.

A forming wire 24 is supported on rolls 19 and 21 which are positioned relative to the breast roll 13 for guiding the forming wire 24 to converge on the foraminous support member 11 at the cylindrical breast roll 13 at an acute angle relative to the foraminous support member 11. The foraminous support member 11 and the wire 24 move at the same speed and in the same direction which is the direction of rotation of the breast roll 13. The forming wire 24 and the foraminous support member 11 converge at an upper surface of the breast roll 13 to form a wedge-shaped space or nip into which one or more jets of water or foamed liquid fiber dispersion may be injected and trapped between the forming wire 24 and the foraminous support member 11 to force fluid through the wire 24 into a save-all 22 where it is collected for re-use in the process, recycled via line 25 to machine chest 50.

The nascent web W formed in the process is carried along the machine direction 30 by the foraminous support member 11 to the pressing roll 17. In order to produce the products of the invention, a spray boom 23 is provided proximate to roll 21 shortly after transfer of web W to foraminous support member 11 and provides a dilute aqueous composition of nanofibrillar cellulose on the Yankee side of nascent web W as shown (i.e. the side of web W applied to the Yankee cylinder). Alternatively, by appropriate configuration of the processing loops, with or without an additional forming fabric, the dilute aqueous composition of nanofibrillar cellulose may be applied to the air side of nascent web W (i.e. the side of web W distal to the Yankee cylinder during drying).

At pressing roll 17, the wet nascent web W is transferred to the Yankee dryer 26. Fluid is pressed from the wet web W by pressing roll 17 as the web is transferred to the Yankee dryer 26 where it is dried and creped by means of a creping blade 27. The finished web is collected on a take-up reel 28.

A pit 44 is provided for collecting water squeezed from the furnish by the press roll 17, as well as collecting the water removed from the fabric by a Uhle box 29. The water collected in pit 44 may be collected into a flow line 45 for separate processing to remove surfactant and fibers from the water and to permit recycling of the water back to the papermaking machine 15.

Nanofibrillar Cellulose

Nanofibrillar cellulose is commonly produced by mechanically disintegrating wood pulp, such as hardwood or softwood Kraft pulp which can include chemical pre- or post-treatments. The pulp used may be pre-processed enzymatically or chemically, for example, to reduce the quantity of hemicellulose. Furthermore, the cellulose fibers may be chemically modified, wherein the cellulose molecules contain functional groups other than in the original cellulose. Such groups include, among others, carboxymethyl (CMC), aldehyde and/or carboxyl groups (cellulose obtained by N-oxyl mediated oxidation, for example "TEMPO"), or quaternary ammonium (cationic cellulose).

Generally, a high shear zone is formed during disintegration to delaminate multilayer cell walls of wood fibers and separate fibrils while minimizing cutting and entangling. This process is used to isolate high aspect ratio, semi-crystalline cellulose fibrils with robust mechanical properties from the wood furnish. Nanofibrils are typically on the order of 4-20 nm wide and 500-2000 nm long. They possess good axial tensile strength due to inter- and intra-molecular hydrogen bonding among highly oriented cellulose molecules. Various processes suitable for making NFC are described in the following references: United States Patent Application Publication No. US 2011/0277947, entitled "Cellulose Nanofilaments and Method to Produce Same", of Hua et al.; United States Patent Application Publication No. US 2014/0083634, entitled "Method and an Apparatus for Producing Nanocellulose", of Bjoerkqvist et al.; and United States Patent Application Publication No. US 2014/0284407, entitled "A Method for Producing Nanofibrillar Cellulose", of Tamper et al.

The fiber morphology influences the amount of energy required to disintegrate it into NFC. Delamination can be facilitated by weakening fiber cell walls or decreasing the strength of fiber-to-fiber bonds through enzymatic or oxidative pretreatments as noted above. Pretreatments can be targeted to certain regions of the fiber or cause a general weakening effect. For example, cellulase enzymes degrade the amorphous portion of the fiber, whereas the TEMPO oxidation weakens the entire surface of the fiber by decreasing the degree of polymerization of cellulose. The TEMPO pretreatment weakens the fiber indiscriminately by converting primary hydroxyl groups of polysaccharides to carboxyl groups. The same techniques can also be used after mechanical fibrillation to achieve a desired quality of NFC. The choice and extent of pretreatment, as well as the morphology of the starting material, will influence the morphology of the nanofibrillated cellulose produced. For example, pulps that undergo extensive enzymatic hydrolysis before disintegration tend to be more uniform in size with a higher degree of crystallinity. With a lower fraction of amorphous cellulose, these fibers look more like cellulose nanocrystals and have a lower specific surface area. Mechanical disintegration with a microgrinder will increase the surface area of the fibrils and cause more branching.

Further details concerning making NFC or MFC with peroxide or ozone are seen in U.S. Pat. No. 7,700,764 to Heijnesson-Hulten, entitled Method of Preparing Microfibrillar Polysaccharide (Akzo Nobel N.V.);United States Patent Application Publication No. US 2015/0167243 of Bilodeau et al., entitled Energy Efficient Process for Preparing Nanocellulose Fibers (University of Maine System Board of Trustees); and U.S. Pat. No. 8,747,612 to Heiskanen et al., entitled Process for the Production of Microfibrillated Cellulose in an Extruder and Microfibrillated Cellulose Produced According to the Process (Stora Enso OYJ). Discussion relating to making NFC or MFC with N-oxyl compounds is seen in U.S. Pat. No. 8,992,728 to Isogai et al., entitled Cellulose Nanofiber, Production Method of Same and Cellulose Nanofiber Dispersion (University of Tokyo); U.S. Pat. No. 8,377,563 to Miyawaki et al., entitled Papermaking Additive and Paper Containing the Same (Nippon Paper Industries Co., Ltd.); and U.S. Pat. No. 8,287,692 to Miyawaki et al., entitled Processes for Producing Cellulose Nanofibers (Nippon Paper Industries Co., Ltd.) which discloses a process for making nanofibers using N-oxyl compounds (TEMPO). References for making NFC or MFC with enzymes include U.S. Pat. No. 8,778,134 to Vehvilainen et al., entitled Process for Producing Microfibrillated Cellulose (Stora Enso OYJ); U.S. Pat. No. 8,728,273 to Heiskanen et al., entitled Process for the Production of a Composition Comprising Fibrillated Cellulose and a Composition (Stora Enso OYJ); U.S. Pat. No. 8,647,468 to Heiskanen et al., entitled Process for Producing Microfibrillated Cellulose (Stora Enso OYJ) which proposes two enzymatic treatments of the pulp used to make microfibers; and U.S. Pat. No. 8,546,558 to Ankerfors et al., entitled Method for the Manufacture of Microfibrillated Cellulose (STFI-Packforsk AB) which also relates to the use of an enzyme treatment. Further details may be seen in WO 2016/122956.

In the foregoing examples, Exilva® NFC, available from Borregaard was utilized. While either the P-series or F-series products may be used, the particular NFC product used was Exilva P 01-L which is provided at a concentration of 2 wt. %.

NFC may also be obtained through the University of Maine; see "The University of Maine—The Process Development Center—Nanofiber R & D," [Online]. Available: http://umaine.edu/pdc/nanofiber-r-d/. [Accessed 24 Nov. 2014]. This source is referred to as NFC I in the characterizations which follow. NFC may also be obtained from Centre Technique du Papier in Grenoble, France. This source will be referred to herein as NFC II. Samples prepared by Georgia Pacific are referred to as NFC III. NFC may also be obtained from Paperlogic, operator of the first US commercial nanocellulose plant at the former Southworth Paper and now Paperlogic mill in Turners Falls, Mass. This source is referred to as NFC PL.

NFC may be characterized by viscosity profiles and breaking length as is discussed below.

Characteristic Nanofiber Viscosity

Characteristic Nanofiber Viscosity may be measured on a suspension of NFC at 1% or 0.5% consistency. Viscosity of the NFC suspensions is measured at room temperature, using a TA instruments Discovery Hybrid Rheometer (DHR) 2. A cone and plate geometry was used for analysis. A few drops of sample are placed on a flat metal peltier plate and the cone spindle, which has a 60 mm diameter and 2° angle, was brought down to make contact with the sample to initiate the spreading action. The sample that flowed out of the circumference of the cone spindle was trimmed. The experimental conditions were as follows: flow logarithmic sweep, shear rate 0.5-2000 Hz at room temperature. Trim and geometric gap was 54 microns. Room temperature means ambient temperature between 23° C. and 29° C., typically. If a specific value is required, 25° C. is used.

Figure 5:
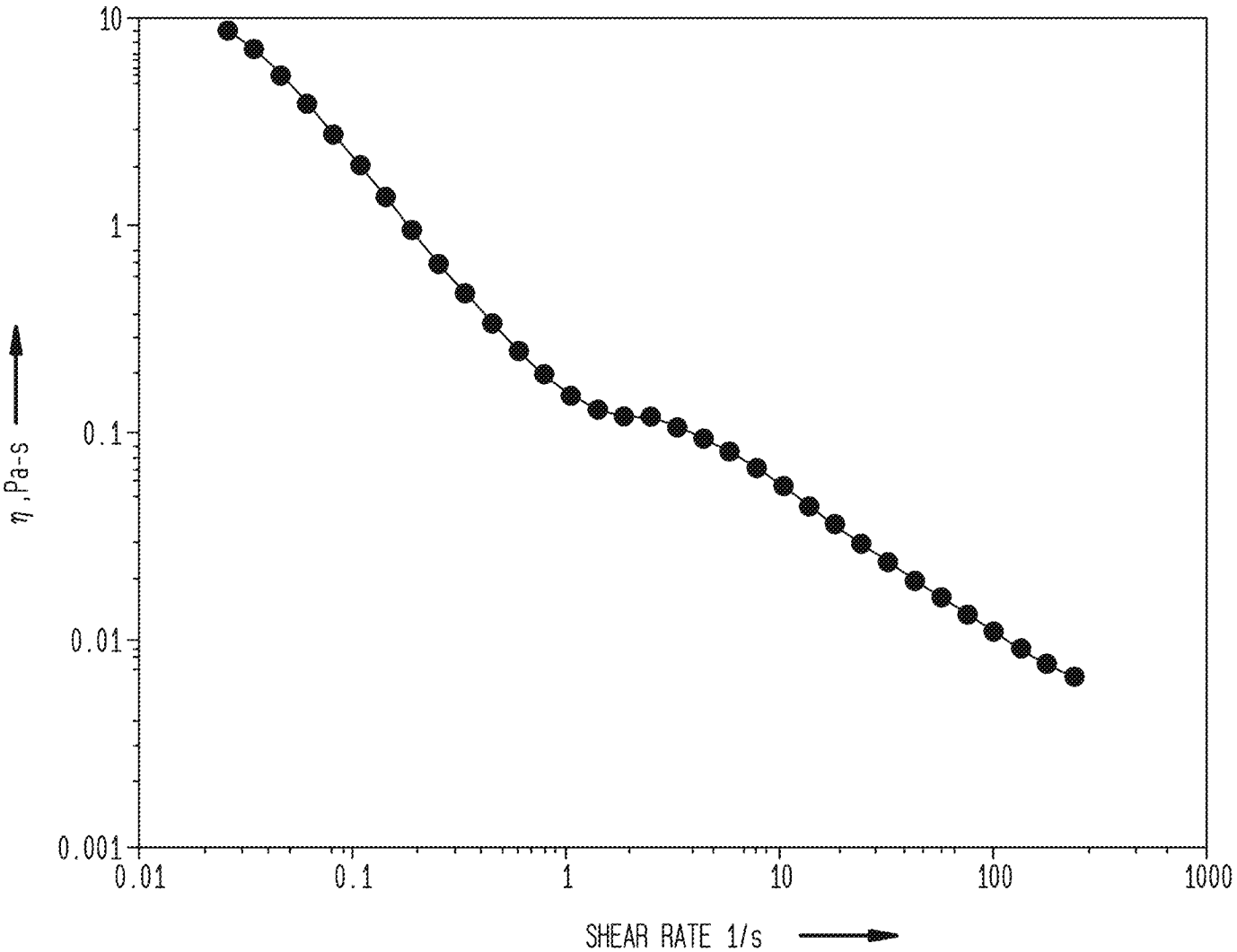
FIG. 5 is a plot of viscosity versus shear rate for Exilva® NFC at 0.5% solids posted on the Exilva blog, 13 Nov. 2018, Mats Hjørnevik, "Important rheological properties of Exilva microfibrillated cellulose"

FIG. 5 presents a plot of Characteristic Nanofiber Viscosity versus shear rate for Exilva® NFC as is measured on a suspension of the material at 0.5% consistency using test methods as generally described above. Viscosity drops from 10 Pa-s to 0.01 Pa-s when shear rate is increased from 0.025 to 250 $s^{-1}$, a viscosity reduction of over 99%.

For the other NFC materials noted above, NFC suspensions were prepared to obtain 1% consistency. The suspensions were then characterized for their viscosity profiles using the test method and apparatus described above. Results appear in Table 4.

TABLE 4

NFC Viscosity Profiles 1% Consistency

| shear rate, 1/s | NFC I Viscosity, cP | NFC II Viscosity, cP | NFC III Viscosity, cP | NFC PL Viscosity, cP |
|---|---|---|---|---|
| 0.5 | 523000 | 989 | 9190 | 47567.1 |
| 0.8 | 366000 | 650 | 5940 | 30257 |
| 1.3 | 237000 | 387 | 4360 | 20858.7 |
| 2.0 | 144000 | 229 | 2910 | 18659.4 |
| 3.2 | 108000 | 144 | 2000 | 20986.7 |
| 5.0 | 80400 | 107 | 1320 | 33391.9 |
| 7.9 | 93300 | 80.9 | 843 | 50741.6 |
| 12.6 | 54100 | 61.2 | 548 | 51552.9 |

TABLE 4-continued

| NFC Viscosity Profiles 1% Consistency | | | | |
|---|---|---|---|---|
| shear rate, 1/s | NFC I Viscosity, cP | NFC II Viscosity, cP | NFC III Viscosity, cP | NFC PL Viscosity, cP |
| 19.9 | 72000 | 50.3 | 579 | 53049.5 |
| 31.5 | 53200 | 53.8 | 1400 | 46991.5 |
| 50.0 | 21900 | 42 | 1300 | 17077.7 |
| 79.2 | 14100 | 23 | 1160 | 9200.18 |
| 126.0 | 5670 | 15.1 | 983 | 9716.41 |
| 199.0 | 2640 | 11.4 | 683 | 5740.54 |
| 315.0 | 1190 | 9.08 | 473 | 3052.84 |
| 500.0 | 553 | 7.61 | 303 | 1381.11 |
| 792.0 | 234 | 6.65 | 198 | 673.671 |
| 1260.0 | 100 | 6.15 | 132 | 307.663 |
| 1990.0 | 45.8 | 6.13 | 75.4 | 123.97 |
| 2000 | 30.8 | 6.03 | 79.5 | 111.68 |

Values are given SI units in Table 4A

TABLE 4a

| NFC Viscosity Profiles | | | | |
|---|---|---|---|---|
| shear rate, 1/s | NFC I Viscosity, Pa-s | NFC II Viscosity, Pa-s | NFC III Viscosity, Pa-s | NFC PL Viscosity, Pa-s |
| 0.5 | 523.0 | 0.989 | 9.190 | 47.567 |
| 0.8 | 366.0 | 0.650 | 5.940 | 30.257 |
| 1.3 | 237.0 | 0.387 | 4.360 | 20.858 |
| 2.0 | 144.0 | 0.229 | 2.910 | 18.659 |
| 3.2 | 108.0 | 0.144 | 2.000 | 20.987 |
| 5.0 | 80.40 | 0.107 | 1.320 | 33.392 |
| 7.9 | 93.30 | 0.081 | 0.843 | 50.742 |
| 12.6 | 54.10 | 0.061 | 0.548 | 51.553 |
| 19.9 | 72.00 | 0.050 | 0.579 | 53.050 |
| 31.5 | 53.20 | 0.054 | 1.400 | 46.992 |
| 50.0 | 21.90 | 0.042 | 1.300 | 17.078 |
| 79.2 | 14.10 | 0.023 | 1.160 | 9.200 |
| 126.0 | 5.670 | 0.015 | 0.983 | 9.716 |
| 199.0 | 2.640 | 0.011 | 0.683 | 5.741 |
| 315.0 | 1.190 | 0.009 | 0.473 | 3.053 |
| 500.0 | 0.553 | 0.008 | 0.303 | 1.381 |
| 792.0 | 0.234 | 0.007 | 0.198 | 0.674 |
| 1260.0 | 0.100 | 0.006 | 0.132 | 0.308 |
| 1990.0 | 0.046 | 0.006 | 0.075 | 0.124 |
| 2000 | 0.031 | 0.006 | 0.080 | 0.111 |

Figure 6:
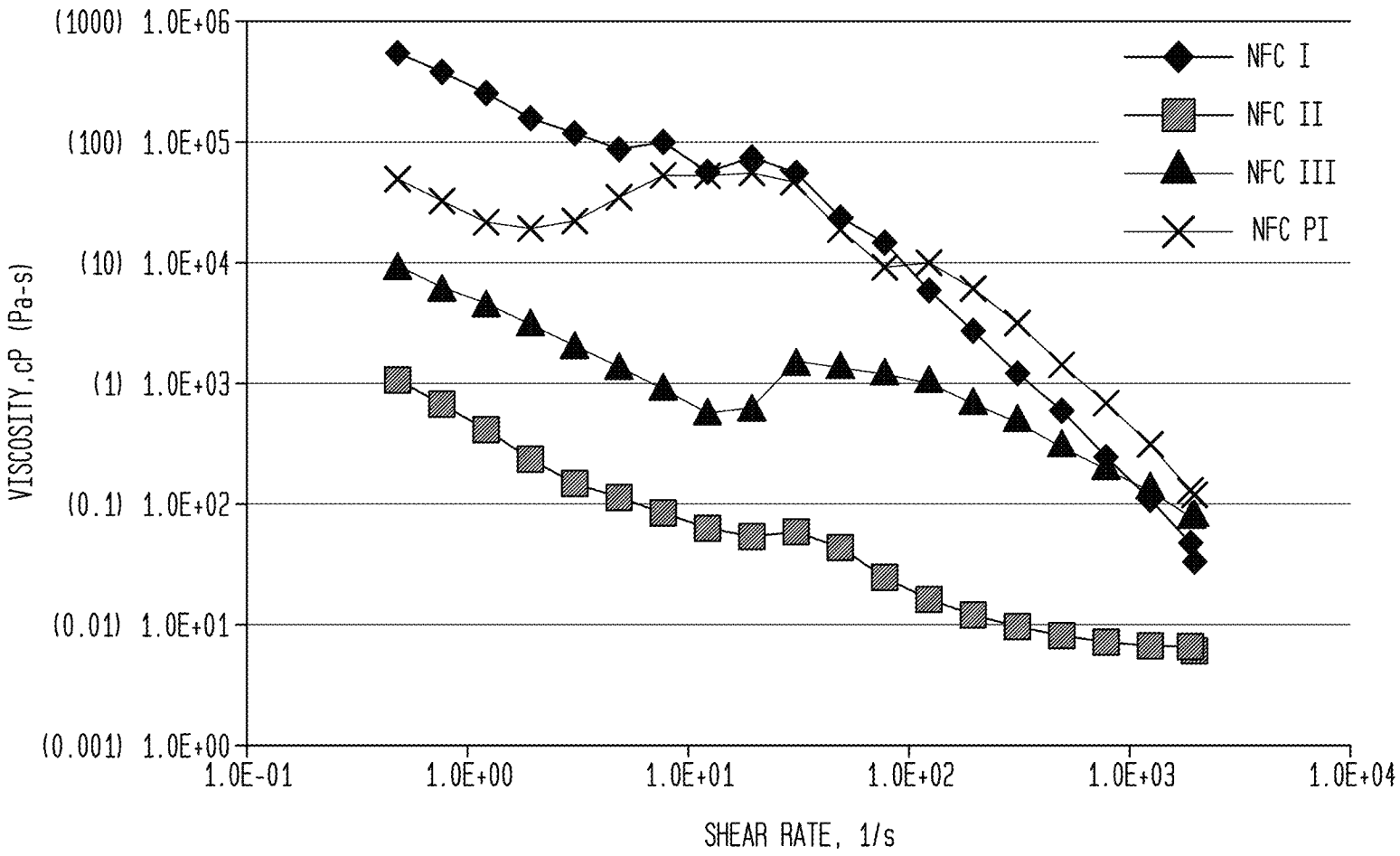
FIG. 6 is a plot of Characteristic Nanofiber Viscosity versus shear rate for 4 grades of NFC at 1% solids.

The data from Table 4 is shown graphically in FIG. 6. It is appreciated from FIG. 6 that NFC properties vary depending upon the degree of fibrillation, especially at low shear. At higher shear rates, viscosity values converge.

NFC Characteristic Breaking Length

100% NFC films or handsheets were formed by vacuum filtration using nylon membrane with 0.45 μm pore size utilizing the NFC I, NFC II, NFC III and NFC Pl materials. Fully restrained drying of NFC films was conducted by attachment of one side of the film to a metal plate and the other side was pressed by a ring with a metal weight on top. The diameter of dried NFC films was 1.5 in (3.81 cm). Each film was cut into a 15 mm×1 in (2.54 cm) strip for tensile testing which provided the information to calculate the breaking length. Results appear in Table 5, as well as in FIG. 7 for four grades of NFC; NFC I, II, III and PL.

TABLE 5

| NFC Properties and Sheet Basis Weight | | |
|---|---|---|
| Sample | Breaking length, km | Basis Weight, g/m$^2$ |
| NFC I | 6.9 | 56 |
| NFC II | 5.9 | 59 |
| NFC III | 5.0 | 69 |
| NFC PL | 6.3 | 62 |

Cellulosic Sheet and Related Terminology

The term "cellulosic", "cellulosic sheet" and the like are meant to include any product incorporating papermaking fiber having cellulose as a major constituent. "Papermaking fibers" include virgin pulps or recycle (secondary) cellulosic fibers or fiber mixes comprising cellulosic fibers. Suitable papermaking fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like. Papermaking fibers used in connection with the invention are typically naturally occurring pulp-derived fibers (as opposed to reconstituted fibers such as lyocell or rayon) which are liberated from their source material by any one of a number of pulping processes familiar to one experienced in the art including sulfate, sulfite, polysulfide, soda pulping, etc. The pulp can be bleached if desired by chemical means including the use of chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). Pulp-derived fibers thus also include high yield fibers such as BCTMP as well as thermomechanical pulp (TMP), chemi-thermomechanical pulp (CTMP) and alkaline peroxide mechanical pulp (APMP). "Furnishes" and like terminology refers to aqueous compositions including papermaking fibers, optionally wet strength resins, debonders and the like for making paper products.

Kraft softwood fiber is low yield fiber made by the well-known Kraft (sulfate) pulping process from coniferous material and includes northern and southern softwood Kraft fiber, Douglas fir Kraft fiber and so forth. Kraft softwood fibers generally have a lignin content of less than 5 percent by weight, a length weighted average fiber length of greater than 2 mm, as well as an arithmetic average fiber length of greater than 0.6 mm.

Kraft hardwood fiber is made by the Kraft process from hardwood sources, e.g. eucalyptus, and also has generally a lignin content of less than 5 percent by weight. Kraft hardwood fibers are shorter than softwood fibers, typically having a length weighted average fiber length of less than 1 mm and an arithmetic average length of less than 0.5 mm or less than 0.4 mm.

Recycle fiber may be added to the papermaking furnish in any amount. While any suitable recycle fiber may be used, recycle fiber with relatively low levels of ground wood is preferred in many cases, for example recycle fiber with less than 15% by weight lignin content, or less than 10% by weight lignin content may be preferred depending on the furnish mixture employed and the application. Recycle fiber is in many cases 80% hardwood fiber.

Products of the invention are made with a cellulosic fiber basesheet and have an absorbency or SAT value as well as tensiles and densities suitable for tissue products. Typical SAT values are greater than about 3 g/g in most cases. See U.S. Pat. No. 8,778,138.

Additives

A wide variety of additives may be included with the NFC coating applied to the tissue substrate including: dispersants; opacifiers such as talc; optical brighteners; softeners such as glycerin, stearates, siloxanes, nonionic surfactants and the like; chemical softeners/debonders such as quaternary ammonium compounds and imidazolinium debonder compositions; as well as lotions and so forth.

Combined glycerin/quaternary ammonium softener compositions are discussed in U.S. Pat. No. 5,558,573 to Funk et al. United States Patent Application Publication No. 2018/0202109 of Chen et al. discusses suitable debonder compositions including ricinoleate-type surfactants and zwitterionic surfactants which may be used with more conventional debonder and/or softener components, such as imidazolinium compounds. There is disclosed in U.S. Pat. No. 7,736,464 to Kokko a debonder composition including a combination of: (a) a quaternary ammonium surfactant component; and (b) a nonionic surfactant component. Typically the nonionic surfactant includes the reaction product of a fatty acid or fatty alcohol with ethylene oxide such as a polyethylene glycol diester of a fatty acid (PEG mono or diols or PEG mono or diesters). Other debonder/softener components such as alkylated quaternary ammonium compounds which may be used are disclosed in the following references: U.S. Pat. No. 5,622,597 to Callen et al.; U.S. Pat. No. 4,441,962 to Osborn, III and U.S. Pat. No. 4,351,699 also to Osborn, III; U.S. Pat. No. 5,698,076 to Phan et al.; U.S. Pat. No. 5,730,839 to Wendt et al.; U.S. Pat. No. 5,753,079 to Jenny et al.; U.S. Pat. No. 4,447,294 to Osborn, III; U.S. Pat. No. 5,279,767 to Phan et al. and U.S. Pat. No. 5,240,562 of Phan et al.

Any of the debonder surfactants discussed in the above references can be used alone or in combination in the NFC suspension applied to the substrate.

Achieving a sufficiently dispersed suspension of NFC can be an issue because the cellulose nanofibrils have a high length to thickness ratio and tend to become entangled, forming fiber flocs. See Rojas et al., the Dispersion Science of Papermaking, Journal of Dispersion Science and Technology, Vol. 25, No. 6, pp. 713-732 (2004). Anionic surfactants may be used as dispersing aids as is seen in U.S. Pat. No. 5,281,348 to Letscher. Anionic surfactants contain anionic functional groups at their head, such as sulfate, sulfonate, phosphate, and carboxylates, i.e. acrylates. Gum-like polymers (i.e. carboxymethylcellulose) can also be used as dispersing aids, these materials improve dispersion by (presumably) reducing inter-fiber friction; however, such polymers can reduce drainage and are sometimes avoided as a dispersing aid in papermaking operations; however this aspect of their usage is less likely to be problematical in the surface layer applied to the nascent web. Cationic polyetheramine dispersants are disclosed in United States Patent Publication No. 2019/0003123.

Any of the dispersing aids described above or listed in the various references noted may be used in the aqueous NFC composition to avoid or minimize aggregates if so desired.

Summary of Exemplary Embodiments

There is provided in accordance with the present invention in a first embodiment, Embodiment No. 1, A method of making a tissue basesheet comprising:

(a) forming a nascent web from an aqueous furnish of papermaking fiber;

(b) applying an aqueous composition of nanofibrillar cellulose to a surface of the nascent web; and (c) drying the nascent web to provide the tissue basesheet.

Embodiment No. 2 is the method according to Embodiment No. 1, wherein the aqueous composition of nanofibrillar cellulose is at a consistency of from 0.3% to 3%.

Embodiment No. 3 is the method according to Embodiment No. 2, wherein the aqueous composition of nanofibrillar cellulose is at a consistency of from 0.5% to 2.5%.

Embodiment No. 4 is the method according to Embodiment No. 3, wherein the aqueous composition of nanofibrillar cellulose is at a consistency of from 1% to 2%.

Embodiment No. 5 is the method according to Embodiment No. 3, wherein the aqueous composition of nanofibrillar cellulose is at a consistency of from 0.75% to 1.5%.

Embodiment No. 6 is the method according to any one of Embodiment Nos. 1 to 5, wherein the aqueous composition of nanofibrillar cellulose is sprayed onto the nascent web.

Embodiment No. 7 is the method according to any one of Embodiment Nos. 1 to 6, wherein the nascent web is dried on a Yankee dryer.

Embodiment No. 8 is the method according to Embodiment No. 7, wherein the aqueous composition of nanofibrillar cellulose is applied to the Yankee side of the nascent web.

Embodiment No. 9 is the method according to Embodiment No. 7, wherein the aqueous composition of nanofibrillar cellulose is applied to the air side of the nascent web.

Embodiment No. 10 is the method according to any one of Embodiment Nos 1 to 10, wherein the nascent web has from 15 $g/m^2$ to 30 $g/m^2$ papermaking fiber.

Embodiment No. 11 is the method according to any one of Embodiment Nos. 1 to 11, wherein the nascent web has from 20 $g/m^2$ to 25 $g/m^2$ of papermaking fiber.

Embodiment No. 12 is the method according to any one of Embodiment Nos. 1 to 11, wherein the nanofibrillar cellulose is applied to the nascent web at a coatweight of from 0.25 $g/m^2$ to 3 $g/m^2$.

Embodiment No. 13 is the method according to any one of Embodiment Nos. 1 to 12, wherein the nanofibrillar cellulose is applied to the nascent web at a coatweight of from 0.4$g/m^2$ to 2 $g/m^2$.

Embodiment No.14 is the method according to any one of Embodiment Nos. 1 to 13, wherein the nanofibrillar cellulose is applied to the nascent web at a coatweight of from 0.4$g/m^2$ to 0.75 $g/m^2$.

Embodiment No. 15 is the method according to any one of Embodiment Nos. 1 to 14, wherein the papermaking fiber in the nascent web is predominantly hardwood papermaking fiber.

Embodiment No. 16 is the method according to any of Embodiment Nos. 1 to 15, wherein the papermaking fiber in the nascent web is from about 60 wt. % to about 70 wt. % hardwood fiber based on the weight of papermaking fiber in the nascent web.

Embodiment No. 17 is the method according to any of Embodiment Nos. 1 to 16, wherein the nascent web is of stratified composition, having a first stratum of predominantly hardwood papermaking fibers and a second stratum of predominantly softwood papermaking fibers.

Embodiment No. 18 is the method according to any of Embodiment Nos. 1 to 17, wherein the nanofibrillar cellulose is composed of cellulose nanofibers having a width of from 3.5 nanometers to 35 nanometers and a length of from 500 nanometers to 4000 nanometers.

Embodiment No. 19 is the method according to any of Embodiment Nos. 1 to 18, wherein the nanofibrillar cellulose is composed of cellulose nanofibers having a width of from 4 nanometers to 25 nanometers and a length of from 1000 nanometers to 3500 nanometers.

Embodiment No. 20 is the method according to any of Embodiment Nos. 1 to 19, wherein the nanofibrillar cellulose exhibits a Characteristic Nanofiber Viscosity reduction at 1% consistency of 60% or more as shear is increased from 5 $sec^{-1}$ to 500 $sec^{-1}$.

Embodiment No. 21 is the method according to any of Embodiment Nos. 1 to 20, wherein the nanofibrillar cellulose exhibits a Characteristic Nanofiber Viscosity reduction at 1% consistency of 80% or more as shear is increased from 5 $sec^{-1}$ to 500 $sec^{-1}$.

Embodiment No. 22 is the method according to any of Embodiment Nos. 1 to 22, wherein the nanofibrillar cellulose exhibits a Characteristic Nanofiber Viscosity reduction at 0.5% consistency of 80% or more as shear is increased from 0.025 $sec^{-1}$ to 250 $sec^{-1}$.

Embodiment No. 23 is the method according to any of Embodiment Nos. 1 to 22, wherein the nanofibrillar cellulose exhibits a Characteristic Nanofiber Viscosity reduction at 0.5% consistency of 90% or more as shear is increased from 0.025 $sec^{-1}$ to 250 $sec^{-1}$.

Embodiment No. 24 is the method according to any one of Embodiment Nos. 1 to 23, wherein the nanofibrillar cellulose exhibits a Characteristic Breaking Length of from 3 kilometers to 10 kilometers.

Embodiment No. 25 is the method according to any one of Embodiment Nos. 1 to 24, wherein the nanofibrillar cellulose exhibits a Characteristic Breaking Length of from 6.5 kilometers to 10 kilometers.

Embodiment No. 26 is the method according to any one of Embodiment Nos. 1 to 25, wherein the aqueous composition of nanofibrillar cellulose includes an additional component selected from softeners, debonders and dispersing aids.

Embodiment No. 27 is the method according to any one of Embodiment Nos. 1 to 26, wherein the aqueous composition of nanofibrillar cellulose includes a softener selected from glycerin, stearates, siloxanes and nonionic surfactants.

Embodiment No. 28 is the method according to any one of Embodiment Nos. 1 to 27, wherein the aqueous composition of nanofibrillar cellulose includes a debonder selected from imidazolinium surfactants and quaternary ammonium surfactants other than imidazolinium surfactants.

Embodiment No. 29 is the method according to any one of Embodiment Nos. 1 to 28, wherein the aqueous composition of nanofibrillar cellulose includes a dispersing aid selected from polymeric dispersants and anionic surfactants.

Embodiment No. 30 is the method according to any of Embodiment Nos. 1 to 29, further comprising incorporating the basesheet into a 2-ply product.

Embodiment No. 31 is the method according to Embodiment No. 30, wherein the 2-ply product has a basis weight of from 30 $g/m^2$ to 60 $g/m^2$.

Embodiment No. 32 is the method according to Embodiment No. 31, wherein the 2-ply product has a basis weight of from 40 $g/m^2$ to 50 $g/m^2$.

Embodiment No. 33 is the method according to any one of Embodiment Nos. 1 to 29, further comprising incorporating the basesheet into a 3-ply product.

Embodiment No. 34 is the method according to Embodiment No. 33, wherein the 3-ply product has a basis weight of from 45 $g/m^2$ to 90 $g/m^2$.

Embodiment No. 35 is the method according to Embodiment No. 34, wherein the 3-ply product has a basis weight of from 60 $g/m^2$ to 75 $g/m^2$.

Embodiment No. 36 is the method according to any one of Embodiment Nos. 30 to 35, wherein the multi-ply product is provided with a layer of nanofibrillar cellulose on an outer surface thereof.

Embodiment No. 37 is a tissue basesheet comprising a tissue substrate of cellulosic papermaking fiber having applied to a surface thereof a layer of nanofibrillar cellulose, the tissue substrate having a basis weight of from 15 $g/m^2$ to 30 $g/m^2$ and the layer of nanofibrillar cellulose having a coatweight of from 0.25 $g/m^2$ to 3 $g/m^2$.

Embodiment No. 38 is the tissue basesheet according to Embodiment No. 37, wherein the layer of nanofibrillar cellulose has a coatweight of from 0.4 $g/m^2$ to 2 $g/m^2$.

Embodiment No. 39 is the tissue basesheet according to Embodiment No. 37, wherein the layer of nanofibrillar cellulose has a coatweight of from 0.4 $g/m^2$ to 0.75 $g/m^2$.

Embodiment No. 40 is the tissue basesheet according to any one of Embodiment Nos. 37 to 29, wherein the tissue substrate of cellulosic papermaking fiber has a basis weight of from 17.5 $g/m^2$ to 27.5 $g/m^2$.

Embodiment No. 41 is the tissue basesheet according to any one of Embodiment Nos. 37 to 40, wherein the tissue substrate of cellulosic papermaking fiber has a basis weight of from 20 $g/m^2$ to 25 $g/m^2$.

Embodiment No. 42 is the tissue basesheet according to any one of Embodiment Nos. 37 to 41, wherein the tissue substrate of papermaking fiber is predominantly hardwood papermaking fiber.

Embodiment No. 43 is the tissue basesheet according to Embodiment No. 42, wherein the tissue substrate of papermaking fiber is from about 60 wt. % to about 70 wt. % hardwood fiber based on the weight of papermaking fiber in the tissue substrate.

Embodiment 44 is the tissue basesheet according to any one of Embodiment Nos. 37 to 43, wherein the tissue substrate of papermaking fiber is of stratified composition, having a first stratum of predominantly hardwood papermaking fibers and a second stratum of predominantly softwood papermaking fibers.

Embodiment No. 45 is the tissue basesheet according to any one of Embodiment Nos. 37 to 44, wherein the tissue basesheet exhibits an increase in GM Tensile of from 20% to 75% as compared to a like tissue basesheet without a layer of nanofibrillar cellulose.

Embodiment No. 46 is the tissue basesheet according to Embodiment No. 45, wherein the tissue basesheet exhibits an increase in GM Tensile of from 25% to 65% as compared to a like tissue basesheet without a layer of nanofibrillar cellulose.

Embodiment No. 47 is the tissue basesheet according to Embodiment No. 45, wherein the tissue basesheet exhibits an increase in GM Tensile of from 40% to 55% as compared to a like tissue basesheet without a layer of nanofibrillar cellulose.

Embodiment No. 48 is the tissue basesheet according to any one of Embodiment Nos. 37 to 47, wherein the nanofibrillar cellulose is composed of cellulose nanofibers having a width of from 3.5 nanometers to 35 nanometers and a length of from 500 nanometers to 4000 nanometers.

Embodiment No. 49 is the tissue basesheet according to any one of Embodiment Nos. 37 to 48, wherein the nanofibrillar cellulose is composed of cellulose nanofibers having a width of from 4 nanometers to 25 nanometers and a length of from 1000 nanometers to 3500 nanometers.

Embodiment No. 50 is the tissue basesheet according to any one of Embodiment Nos. 37 to 49, wherein the nanofibrillar cellulose exhibits a Characteristic Nanofiber Viscosity reduction at 1% consistency of 60% or more as shear is increased from 5 $sec^{-1}$ to 500 $sec^{-1}$.

Embodiment No. 51 is the tissue basesheet according to any one of Embodiment Nos. 37 to 50, wherein the nanofibrillar cellulose exhibits a Characteristic Nanofiber Viscosity reduction at 1% consistency of 80% or more as shear is increased from 5 $sec^{-1}$ to 500 $sec^{-1}$.

Embodiment No. 52 is the tissue basesheet according to any one of Embodiment Nos. 37 to 51, wherein the nanofibrillar cellulose exhibits a Characteristic Nanofiber Viscosity reduction at 0.5% consistency of 80% or more as shear is increased from 0.025 $sec^{-1}$ to 250 $sec^{-1}$.

Embodiment No. 53 is the tissue basesheet according to any one of Embodiment Nos. 37 to 52, wherein the nanofibrillar cellulose exhibits a Characteristic Nanofiber Viscosity reduction at 0.5% consistency of 90% or more as shear is increased from 0.025 $sec^{-1}$ to 250 $sec^{-1}$.

Embodiment No. 54 is the tissue basesheet according to any one of Embodiment Nos. 37 to 53, wherein the nanofibrillar cellulose exhibits a Characteristic Breaking Length of from 3 kilometers to 10 kilometers.

Embodiment No. 55 is the tissue basesheet according to any one of

Embodiment Nos. 37 to 54, wherein the nanofibrillar cellulose exhibits a Characteristic Breaking Length of from 6.5 kilometers to 10 kilometers.

Embodiment No. 56 is the tissue basesheet according to any one of Embodiment Nos. 37 to 55, wherein the layer of nanofibrillar cellulose includes an additional component selected from softeners, debonders and dispersing aids.

Embodiment No. 57 is the tissue basesheet according to any one of Embodiment Nos. 37 to 56, wherein the layer of nanofibrillar cellulose includes a softener selected from glycerin, stearates, siloxanes and nonionic surfactants.

Embodiment No. 58 is the tissue basesheet according to any one of Embodiment Nos. 37 to 57, wherein the layer of nanofibrillar cellulose includes a debonder selected from imidazolinium surfactants and quaternary ammonium surfactants other than imidazolinium surfactants.

Embodiment No. 59 is the tissue basesheet according to any one of Embodiment Nos. 37 to 58, wherein the layer of nanofibrillar cellulose includes a dispersing aid selected from polymeric dispersants and anionic surfactants.

Embodiment No. 60 is the tissue basesheet according to any one of Embodiment Nos. 37 to 59, incorporated into a 2-ply product.

Embodiment No. 61 is the 2-ply product according to Embodiment No. 60, wherein the 2-ply product has a basis weight of from 30 $g/m^2$ to 60 $g/m^2$.

Embodiment No. 62 is the 2-ply product according to Embodiment No. 60, wherein the 2-ply product has a basis weight of from 40 $g/m^2$ to 50 $g/m^2$.

Embodiment No. 63 is the 2-ply product according to any one of Embodiment Nos. 60 to 62, wherein the 2-ply product exhibits an increase in GM Tensile of from 20% to 75% as compared to a like 2-ply product without a layer of nanofibrillar cellulose.

Embodiment No. 64 is the 2-ply product according to Embodiment No. 63, wherein the 2-ply product exhibits an increase in GM Tensile of from 25% to 65% as compared to a like 2-ply product without a layer of nanofibrillar cellulose.

Embodiment No. 65 is the 2-ply product according to any one of Embodiment Nos. 60 to 64, wherein the 2-ply product exhibits an increase in GM Tensile of from 40% to 55% as compared to a like 2-ply product without a layer of nanofibrillar cellulose.

Embodiment No. 66 is the tissue basesheet according to any one of Embodiment Nos. 37 to 59, incorporated into a 3-ply product.

Embodiment No. 67 is the 3-ply product according to Embodiment No. 66, wherein the 3-ply product has a basis weight of from 45 $g/m^2$ to 90 $g/m^2$.

Embodiment No. 68 is the 3-ply product according to Embodiment No. 66, wherein the 3-ply product has a basis weight of from 60 $g/m^2$ to 75$g/m^2$.

Embodiment No. 69 is the 3-ply product according to any one of Embodiment Nos. 66 to 68, wherein the 3-ply product exhibits an increase in GM Tensile of from 20% to 75% as compared to a like 3-ply product without a layer of nanofibrillar cellulose.

Embodiment No. 70 is the 3-ply product according to Embodiment No. 69, wherein the 3-ply product exhibits an increase in GM Tensile of from 25% to 65% as compared to a like 3-ply product without a layer of nanofibrillar cellulose.

Embodiment No. 71 is the 3-ply product according to Embodiment 69, wherein the 3-ply product exhibits an increase in GM Tensile of from 40% to 55% as compared to a like 3-ply product without a layer of nanofibrillar cellulose.

Embodiment No. 72 is the multi-ply product according to any one of Embodiment Nos. 60 to 71, wherein the multi-ply product is provided with a layer of nanofibrillar cellulose on an outer surface thereof.

Embodiment No. 73 is the multi-ply product according to any one of Embodiment Nos. 60 to 72, wherein the multi-ply product exhibits a panel softness decrease of less than 5% as compared to a like multi-ply product without a layer of nanofibrillar cellulose.

Embodiment No. 74 is the tissue basesheet according to any one of Embodiment Nos. 37 to 59 and the multi-ply product according to any one of Claims 60 to 73, wherein the tissue basesheet is prepared by the method of any one of Claims 1 to 29.

While the invention has been described in detail, modifications within the spirit and scope of the invention will be readily apparent to those of skill in the art. Such modifications are also to be considered as part of the present invention. In view of the foregoing discussion, relevant knowledge in the art and references discussed above in connection with the foregoing description including the Detailed Description and Background of the Invention, the disclosures of which are all incorporated herein by reference, further description is deemed unnecessary. In addition, it should be understood from the foregoing discussion that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A tissue basesheet comprising a tissue substrate of cellulosic papermaking fiber having applied to a surface thereof a layer of nanofibrillar cellulose, the tissue substrate having a basis weight of from 15 $g/m^2$ to 30 $g/m^2$ and the layer of nanofibrillar cellulose upon the tissue substrate having a coatweight of nanofibrillar cellulose of from 0.25 $g/m^2$ to 3 $g/m^2$, wherein the tissue basesheet exhibits an increase in GM Tensile of from 20% to 75% as compared to a like tissue basesheet without a layer of nanofibrillar cellulose.

2. The tissue basesheet according to claim 1, wherein the layer of nanofibrillar cellulose has a coatweight of from 0.4 $g/m^2$ to 2 $g/m^2$.

3. The tissue basesheet according to claim 1, wherein the layer of nanofibrillar cellulose has a coatweight of from 0.4 $g/m^2$ to 0.75 $g/m^2$.

4. The tissue basesheet according to claim 1, wherein the tissue substrate of cellulosic papermaking fiber has a basis weight of from 20 $g/m^2$ to 25 $g/m^2$.

5. The tissue basesheet according to claim 1, wherein the tissue substrate of papermaking fiber is predominantly hardwood papermaking fiber.

6. The tissue basesheet according to claim 1, wherein the tissue substrate of papermaking fiber is from about 60 wt. % to about 70 wt. % hardwood fiber based on the weight of papermaking fiber in the tissue substrate.

7. The tissue basesheet according to claim 1, wherein the tissue substrate of papermaking fiber is of stratified composition, having a first stratum of predominantly hardwood papermaking fibers and a second stratum of predominantly softwood papermaking fibers.

8. The tissue basesheet according to claim 1, wherein the tissue basesheet exhibits an increase in GM Tensile of from 25% to 65% as compared to a like tissue basesheet without a layer of nanofibrillar cellulose.

9. The tissue basesheet according to claim 1, wherein the tissue basesheet exhibits an increase in GM Tensile of from 40% to 55% as compared to a like tissue basesheet without a layer of nanofibrillar cellulose.

10. The tissue basesheet according to claim 1, wherein the nanofibrillar cellulose is composed of cellulose nanofibers having a width of from 3.5 nanometers to 35 nanometers and a length of from 500 nanometers to 4000 nanometers.

11. The tissue basesheet according to claim 1, wherein the nanofibrillar cellulose is composed of cellulose nanofibers having a width of from 4 nanometers to 25 nanometers and a length of from 1000 nanometers to 3500 nanometers.

12. The tissue basesheet according to claim 1, wherein the nanofibrillar cellulose exhibits a Characteristic Nanofiber Viscosity reduction at 1% consistency of 60% or more as shear is increased from 5 $sec^{-1}$ to 500 $sec^{-1}$.

13. The tissue basesheet according to claim 1, wherein the nanofibrillar cellulose exhibits a Characteristic Nanofiber Viscosity reduction at 1% consistency of 80% or more as shear is increased from 5 $sec^{-1}$ to 500 $sec^{-1}$.

14. The tissue basesheet according to claim 1, wherein the nanofibrillar cellulose exhibits a Characteristic Nanofiber Viscosity reduction at 0.5% consistency of 80% or more as shear is increased from 0.025 $sec^{-1}$ to 250 $sec^{-1}$.

15. The tissue basesheet according to claim 1, wherein the nanofibrillar cellulose exhibits a Characteristic Nanofiber Viscosity reduction at 0.5% consistency of 90% or more as shear is increased from 0.025 $sec^{-1}$ to 250 $sec^{-1}$.

16. The tissue basesheet according to claim 1, wherein the layer of nanofibrillar cellulose includes an additional component selected from softeners, debonders and dispersing aids.

17. The tissue basesheet according to claim 1, incorporated into a multi-ply product.

18. The tissue basesheet according to claim 17, wherein the multi-ply product is a 2-ply or a 3-ply product.

19. The multi-ply product according to claim 17, wherein the multi-ply product is provided with a layer of nanofibrillar cellulose on an outer surface thereof.

20. A tissue basesheet comprising a tissue substrate of cellulosic papermaking fiber having applied to a surface thereof a layer of nanofibrillar cellulose, the tissue substrate having a basis weight of from 15 $g/m^2$ to 30 $g/m^2$ and the layer of nanofibrillar cellulose upon the tissue substrate having a coatweight of nanofibrillar cellulose of from 0.25 $g/m^2$ to 3 $g/m^2$, wherein the nanofibrillar cellulose exhibits a Characteristic Breaking Length of from 3 kilometers to 10 kilometers.

21. The tissue basesheet according to claim 20, wherein the nanofibrillar cellulose exhibits a Characteristic Breaking Length of from 6.5 kilometers to 10 kilometers.

* * * * *